US008471886B2

(12) United States Patent
Shoji

(10) Patent No.: US 8,471,886 B2
(45) Date of Patent: Jun. 25, 2013

(54) IMAGE FORMING APPARATUS AND CONTROL METHOD

(75) Inventor: Atsuchi Shoji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 483 days.

(21) Appl. No.: 12/718,379

(22) Filed: Mar. 5, 2010

(65) Prior Publication Data

US 2010/0238258 A1 Sep. 23, 2010

(30) Foreign Application Priority Data

Mar. 19, 2009 (JP) ..... 2009-069010

(51) Int. Cl.
*B41J 2/47* (2006.01)
*B41J 2/435* (2006.01)

(52) U.S. Cl.
USPC ..... 347/254; 347/236; 347/246

(58) Field of Classification Search
USPC ..... 347/246, 236, 247, 254
See application file for complete search history.

(56) References Cited

U.S. PATENT DOCUMENTS

| | | | | |
|---|---|---|---|---|
| 6,459,520 | B1 | 10/2002 | Takayama | |
| 6,791,596 | B2 * | 9/2004 | Nihei et al. | 347/247 |
| 2004/0246329 | A1 * | 12/2004 | Yoshida | 347/237 |
| 2007/0115339 | A1 * | 5/2007 | Matsuzaki et al. | 347/118 |
| 2007/0200911 | A1 * | 8/2007 | Nakatsu | 347/249 |

FOREIGN PATENT DOCUMENTS

| | | | |
|---|---|---|---|
| JP | 2000-071516 | A | 3/2000 |
| JP | 2000-089148 | A | 3/2000 |
| JP | 2000-221424 | A | 8/2000 |
| JP | 2004-009336 | A | 1/2004 |
| JP | 2006-187868 | A | 7/2006 |
| JP | 2006-208697 | A | 10/2006 |

OTHER PUBLICATIONS

Office Action—Japanese Patent Appln. No. 2009-069010, Japanese Patent Office, mailed Mar. 18, 2013.

* cited by examiner

*Primary Examiner* — Stephen Meier
*Assistant Examiner* — Sarah Al Hashimi
(74) *Attorney, Agent, or Firm* — Fitzpatrick, Cella, Harper & Scinto

(57) ABSTRACT

An electrophotographic image forming apparatus performs latent image rendering using a plurality of light sources. The electrophotographic image forming apparatus includes a rendering time control unit that controls a latent image rendering start time for each of the light sources, a scanning time control unit that controls a scanning start time for each of the light sources, a pattern forming unit that forms a pixel pattern corresponding to pixel pattern data defined in advance on a photosensitive member, and a density detection unit that detects a density of the pixel pattern formed on the photosensitive member. The rendering time control unit and the scanning time control unit respectively control the rendering start time and the scanning start time for each of the light sources using a density value detected by the density detection unit.

4 Claims, 15 Drawing Sheets

PRINT IMAGE

ELECTRIC
POTENTIAL LEVEL

TONER IMAGE

IMAGE FORMING APPARATUS AND CONTROL METHOD

BACKGROUND OF THE INVENTION

1. Field of the Invention

The present invention relates to an electrophotographic image forming apparatus that has a rendering system using multi-light source simultaneous scanning, for example.

2. Description of the Related Art

With electrophotographic image forming apparatuses that use a plurality of light sources, it is possible to increase the scanning density when using an element having a wide light source interval by employing an oblique arrangement as shown in FIG. 1, for example. Since the positions of the light sources in the scanning direction are different in order to compensate for such an oblique arrangement, the timing of the driving signal for each of the light sources is also different. The beams of light from the respective light sources simultaneously scanned are concentrated on a small area spatially and temporally, which makes it difficult to separate synchronization signals using a sensor. Accordingly, it is difficult to achieve light source synchronization, which is for aligning a rendering position on a photosensitive member, for each of the individual light sources.

As a low-cost substitute method, there is a method in which only one light source is synchronized among multiple light sources, and a substitute is used for the remaining light sources. For example, assuming that the difference in scanning timing between light sources of the multiple light sources is always constant depending on the spatial arrangement of the light sources, by measuring the difference in scanning timing between the light sources in advance, the scanning timings of the remaining light sources can be calculated from the scanning timing of one light source used as a reference. The amount of timing delay is measured in advance using a sensor, for instance, and synchronization signals for scanning timings of the remaining light sources are generated from the synchronization signal of the one light source and the measured amount of delay (see Japanese Patent Laid-Open No. 2006-187868).

Further, in order to correct shift that has occurred from a difference between scanning angles, for instance, caused by the physical structure of an optical system or the like, a scanning timing of the actual optical system, and the scanning speed of scanning performed on the photosensitive member corresponding to the scanning timing are measured for each light source. Then, it is necessary to correct a rendering start time of one pixel for each light source, and the time difference in scanning timing between the light sources. As a measurement method, a method for performing two-point light measurement has been proposed (see Japanese Patent Laid-Open No. 2006-208697, for instance).

However, by increasing the number of light sources, with the method disclosed in Japanese Patent Laid-Open No. 2006-187868 as described above and the like, the scanning timings between the light sources do not fully match in many cases. Particularly, if a plurality of light sources are shifted and arranged as shown in FIG. 1, the optical path length (optical distance) to a photosensitive member varies for each light source. Accordingly, unlike single-light-source scanning, with multi-light-source scanning, due to fluctuation in the optical distance, fluctuation occurs in the difference in scanning timing between the light sources. Although this phenomenon is not very prominent with approximately two light sources, a problem with pixel shift in the main-scanning and sub-scanning directions occurs as the number of light sources increases. Further, with the method disclosed in Japanese Patent Laid-Open No. 2006-208697 and the like, a method according to which a plurality of scanning timing measurement means are provided results in a disadvantageous mechanical configuration in terms of cost and volume.

SUMMARY OF THE INVENTION

In view of the above, the present invention provides an electrophotographic image forming apparatus that, even with the configuration in which only one scanning timing detection means is provided for one photosensitive member, eliminates pixel shift between the light sources, and uses a plurality of light sources with the same pixel rendering width and aligned scan image start positions.

According to one aspect of the present invention, there is provided an electrophotographic image forming apparatus that performs latent image rendering using a plurality of light sources, the electrophotographic image forming apparatus comprising: a rendering time control unit that controls a latent image rendering start time for each of the light sources; a scanning time control unit that controls a scanning start time for each of the light sources; a pattern forming unit that forms a pixel pattern corresponding to pixel pattern data defined in advance on a photosensitive member; and a density detection unit that detects a density of the pixel pattern formed on the photosensitive member, wherein the rendering time control unit and the scanning time control unit respectively control the rendering start time and the scanning start time for each of the light sources using a density value detected by the density detection unit.

According to the present invention, it is possible to, without providing a plurality of expensive photosensors with high speed responsivity and high resolution to each photosensitive member, correct variations with respect to pixel clocks of a plurality of light sources and positional shift thereof due to environmental fluctuation, and to maintain print output quality.

Further features of the present invention will become apparent from the following description of exemplary embodiments with reference to the attached drawings.

DESCRIPTION OF THE EMBODIMENTS

First Embodiment

Depending on printing mechanisms, in order to stably control print density, a density reading pattern may be formed between two electrostatic latent images on an image carrier corresponding to images that are to be fixed on two sheets, or outside the printing area corresponding to an image that is to be fixed on a sheet, and may be developed as a toner image. The print density is controlled by reading the density of this toner image on a photosensitive member or a transfer member serving as an image carrier, and the toner image is discarded so as not to be transferred to an output sheet. In the present embodiment, by utilizing a density sensor mounted for stable density control, main-scanning variations between light sources is corrected. Note that in the present embodiment, a description is given calling an image forming apparatus a printing apparatus. Therefore, in the following description, "printing" can be replaced with "image formation".

Pixel Pattern for Density Detection

Figure 1:
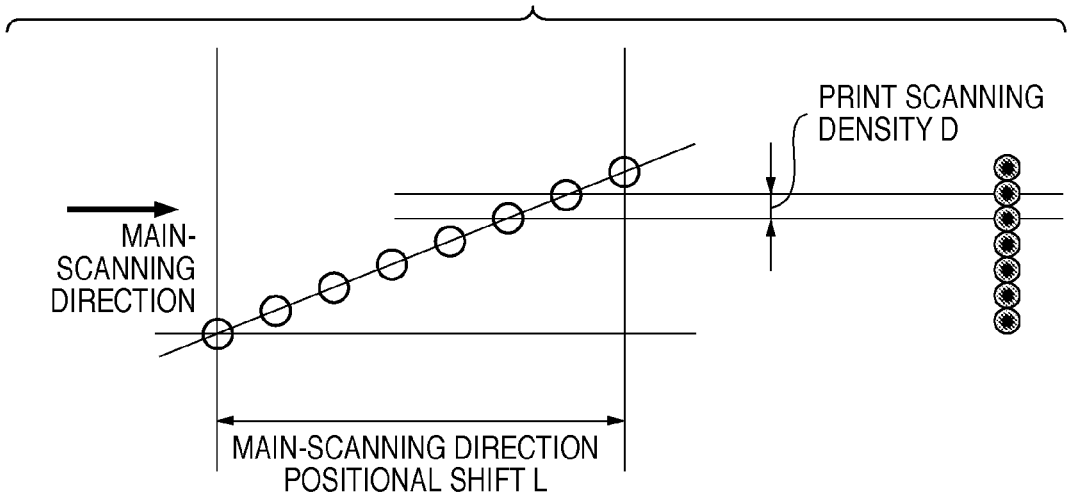
FIG. 1 is a schematic diagram that illustrates that a light source array has an oblique arrangement.
Figure 2:
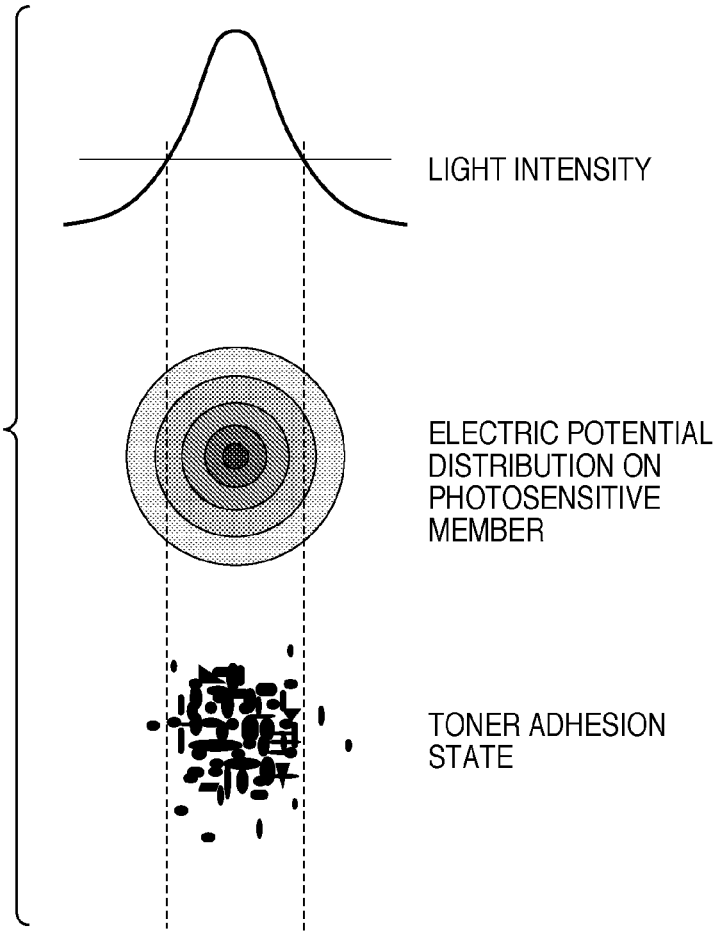
FIG. 2 is a schematic diagram that shows correspondence between light intensity, electric potentials that are generated, and a toner adhesion state.

As shown in FIG. 2, the light intensity of a laser beam, which is a light source, has a Gaussian distribution, and also electric potentials formed on the photosensitive member do not have a sharp shape, but instead have an electric potential distribution that spreads outward. Toner intensively adheres in a region including sufficient electric charge for toner to adhere, and although toner may adhere in a region where the electric potential is low around the toner adhesion region, such a region does not stably attract toner, resulting in a sparse distribution. The electrophotographic laser beam of light is not relatively sharp with respect to the pixel size, and the Gaussian distribution also has a gentle shape with respect to the pixel size. Here, rendering is performed with a scanning density with which regions where weak electric charge images are generated are overlapped with each other. Due to peripheral electric charge generation regions overlapping, a region where a plurality of light-scanning renderings are superimposed has a sufficient amount of electric charges for causing toner to adhere, thus increasing the density. A pixel pattern is defined such that utilizing such properties, the positional fluctuation of pixels is most sensitively detected and is converted into density.

Figure 3:
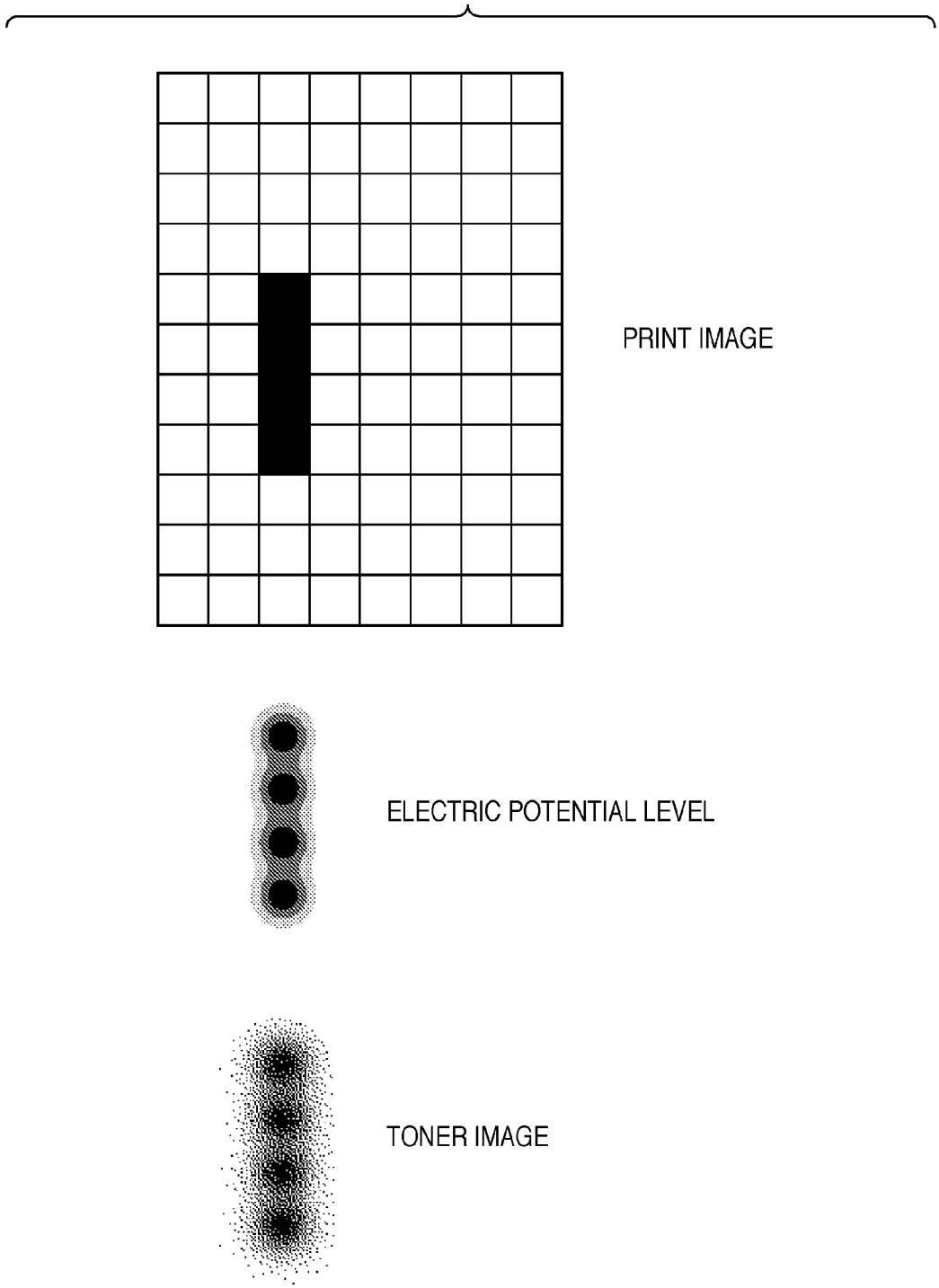
FIG. 3 is a diagram that shows correspondence between pixel images, potential levels, and a toner adhesion state of a pixel pattern.
Figure 4:
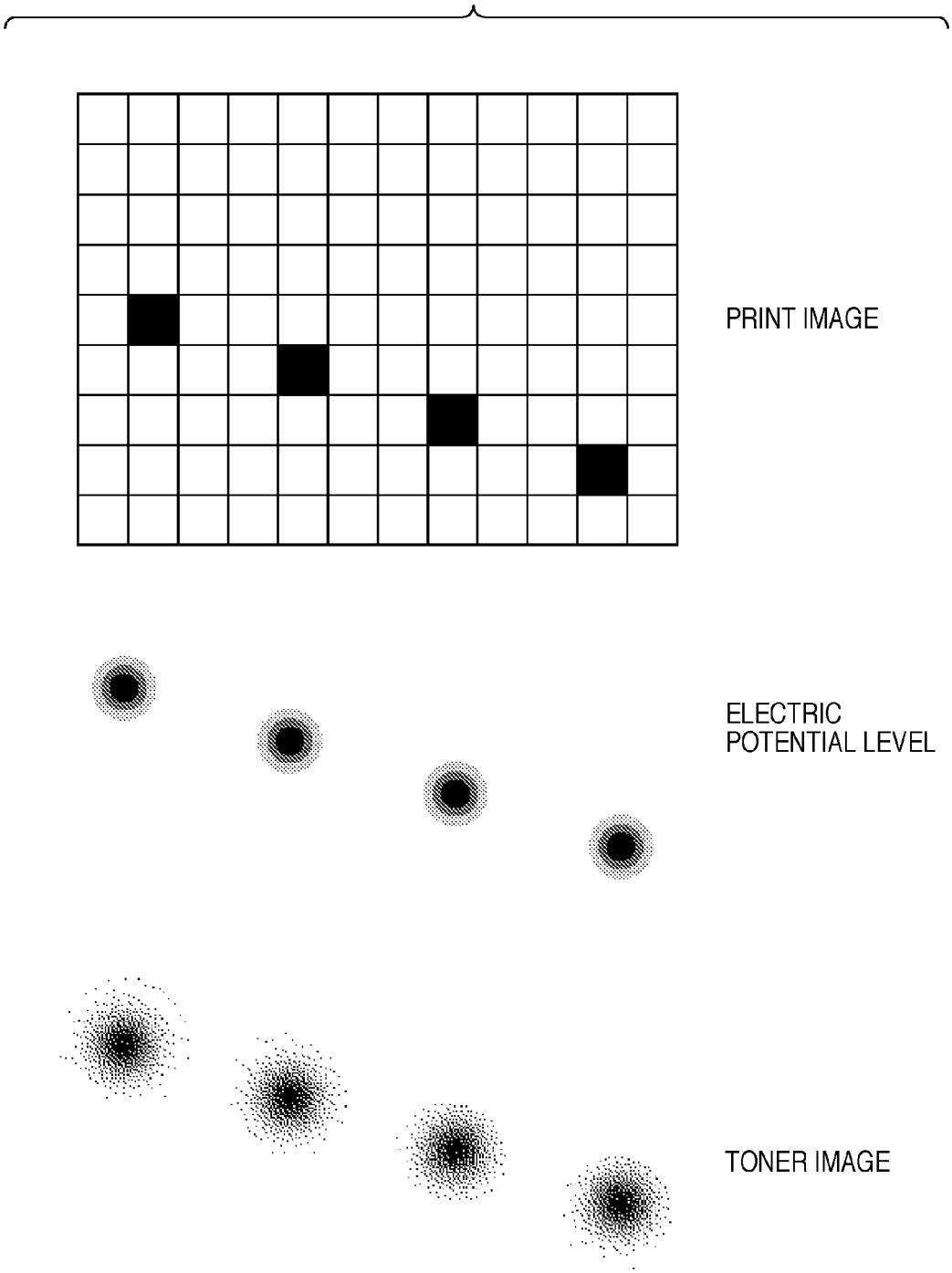
FIG. 4 is a diagram that shows correspondence between pixel images, potential levels, and a toner adhesion state of a pixel pattern.
Figure 6:
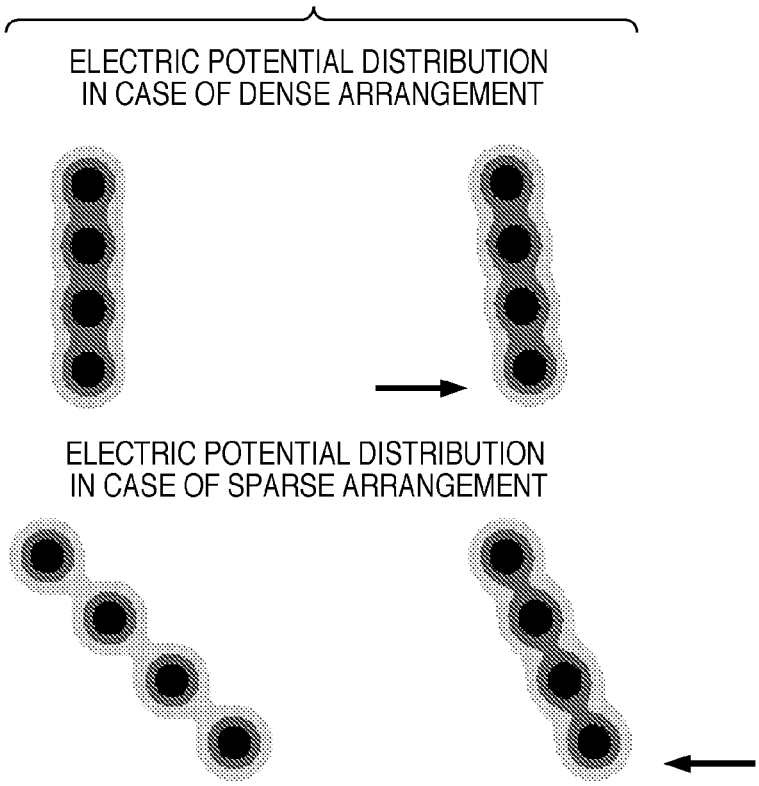
FIG. 6 is a schematic diagram that shows fluctuation in an electric potential distribution when a rendering position shifts.

For example, as shown in FIG. 3, in the case of a pixel pattern in which the pixel positions are contiguous in a sub-scanning direction on the image carrier, the electric charge generation regions are mostly overlapped. In contrast to this, as shown in FIG. 4, in the case of a pixel pattern in which pixels are separated from each other, the electric charge generation regions are not at all in contact with each other. In the case of a dense arrangement as shown in FIG. 3, even if the pixel positions fluctuate slightly as shown in FIG. 6, the electric potential distribution area hardly changes, and the toner adhesion region does not greatly fluctuate. Furthermore, with a discrete pattern as shown in FIG. 4, even if the pixel positions fluctuate slightly, the pixels do not influence each other, and accordingly the amount of toner adhesion does not change. In other words, with such pixel patterns, synchronization and pixel width fluctuation cannot be converted into density and detected.

Figure 5:
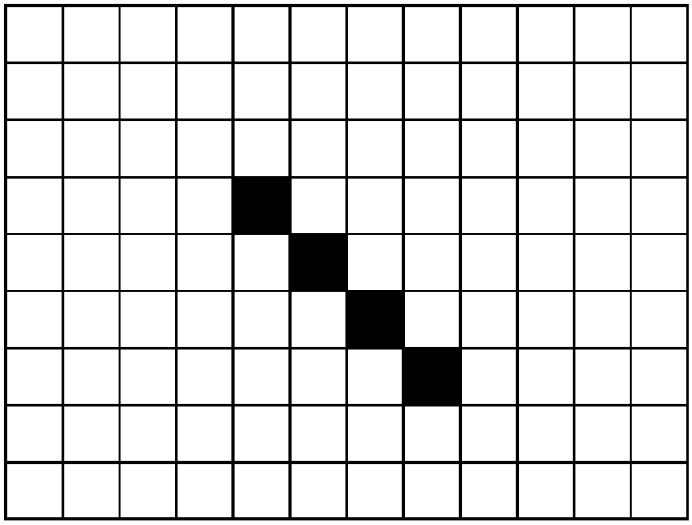
FIG. 5 is a diagram that shows correspondence between pixel images, potential levels, and a toner adhesion state of a pixel pattern.
Figure 5:
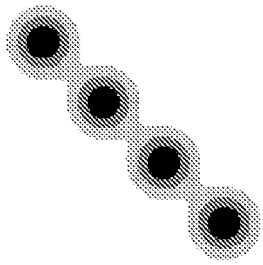
Figure 5:
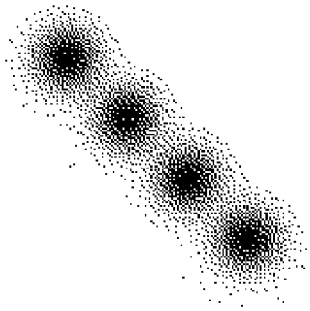

In view of this, as shown in FIG. 5, a pixel pattern in which weak electric charge generation regions of adjoining pixels slightly overlap is defined. In the case of the pixel pattern arranged as shown in FIG. 5, as in the electric potential distribution of sparse arrangement shown in FIG. 6, if an image is distorted in the approaching direction, there is an increase in the number of regions where the electric potential at which toner adheres is reached, thus resulting in an increase in density. Similarly, when an image is distorted in the opposite direction and the individual pixels move in the direction of becoming dispersed, a decrease in density can be expected. Note that although depending on the electrophotographic properties there are cases in which an apparatus is sensitive to only either an increase or a decrease in density, if the distortion direction is opposite in that case, a pixel pattern that has been flipped horizontally may be defined, and may be read again. Although the optimal image for detection differs depending on electrophotographic properties, in any case, it is necessary to perform rendering in which the phases of the image positions and the light sources are matched. Accordingly, synchronization and pixel width fluctuation can be converted into density and detected. By adjusting the pixel cycle of each light source in conformity with an extracted density difference, rendering start timings are synchronized.

Figure 7:
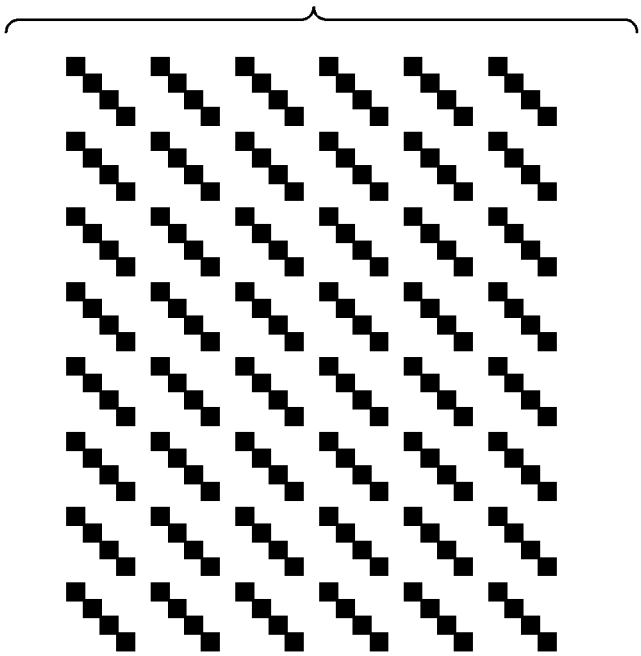
FIG. 7 is a drawing showing an example of a patch pattern for density measurement according to an embodiment of the present invention.

First, when the number of light sources is K, an image pattern is also constituted from K pixels in correspondence with the light source. For example, the pixel pattern shown in FIG. 5 is for when K=4. FIG. 7 shows repetition of this pixel pattern defined as a basic pattern, which enables density detection. Control is performed by rendering the pixel pattern as shown in FIG. 7 in a position where a density detection sensor can read, and reading the toner image on the photosensitive member or the transfer member with the density detection sensor. If a plurality of pixel patterns are read, a few pixel patterns are vertically aligned at positions where the density detection sensor can read. Note that pixel patterns are held in the apparatus as pixel pattern data.

Figure 9:
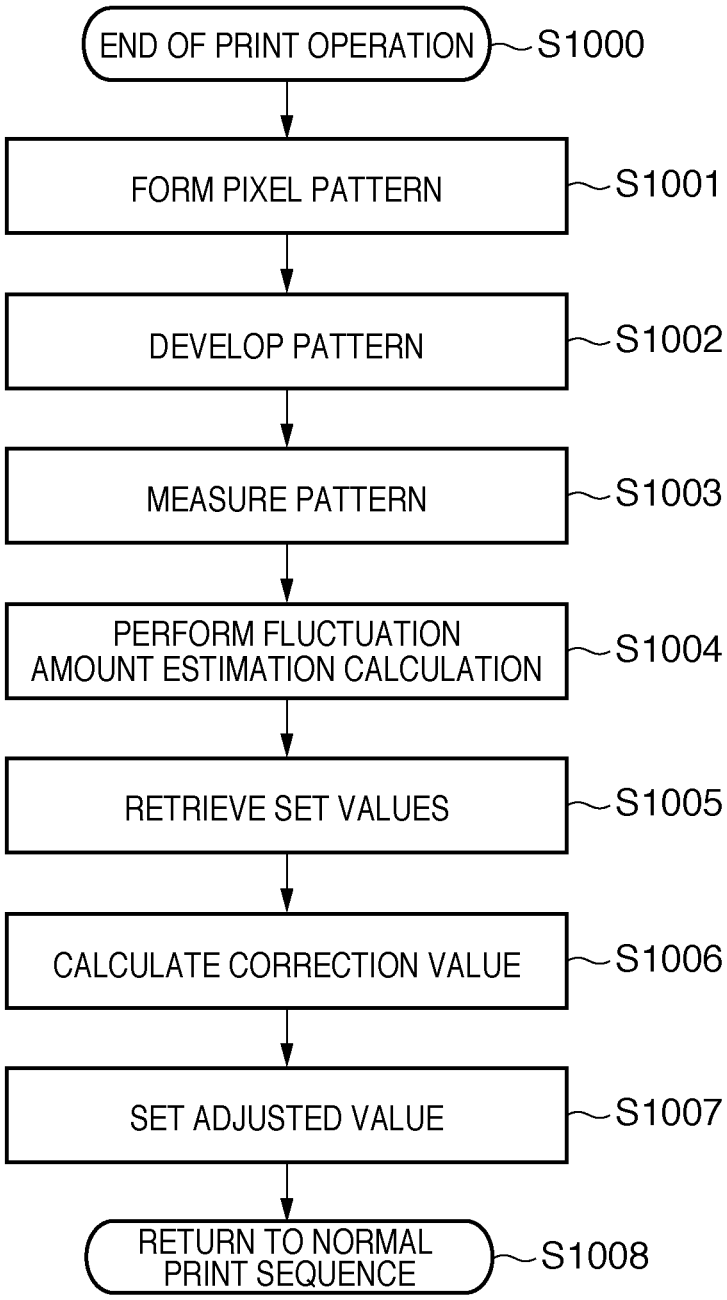
FIG. 9 is a flowchart that shows processing according to the first embodiment.

Here, a description is given regarding estimation calculation for the amount of pixel fluctuation and correction value calculation that are performed as shown in FIG. 9. In this processing, expansion and shrinkage (a correction value) of an image is judged based on a combination of a pattern direction and a density fluctuation direction. For example, suppose that when the density in FIG. 7 is detected, an increase in the density of the pattern toward the scanning direction is detected. In this case, since the pixel density is increasing towards the end of a scanning line, it can be judged that image shrinkage has been occurred. In the case of judging that image shrinkage has been occurred, in order to correct scanning for each light source, it is necessary to perform control either for correction of the pixel clock of the lower light source to a lower frequency, or for correction of the upper light source to a higher frequency. If a decrease in density is detected, opposite control is necessary. Further, in the case in which the print output is synchronized on the left side of the image, even if the density fluctuates, it is judged that there is shift in the synchronization signal if the density is the same on the right side and left side of an image. By performing above processing, a correction value is estimated based on density fluctuation. Note that correspondence between a detected shift value and a correction value is different for each apparatus. Correction of a pixel clock can be realized using a VCO (Voltage Controlled Oscillator), for example.

Hardware Configuration

Figure 8:
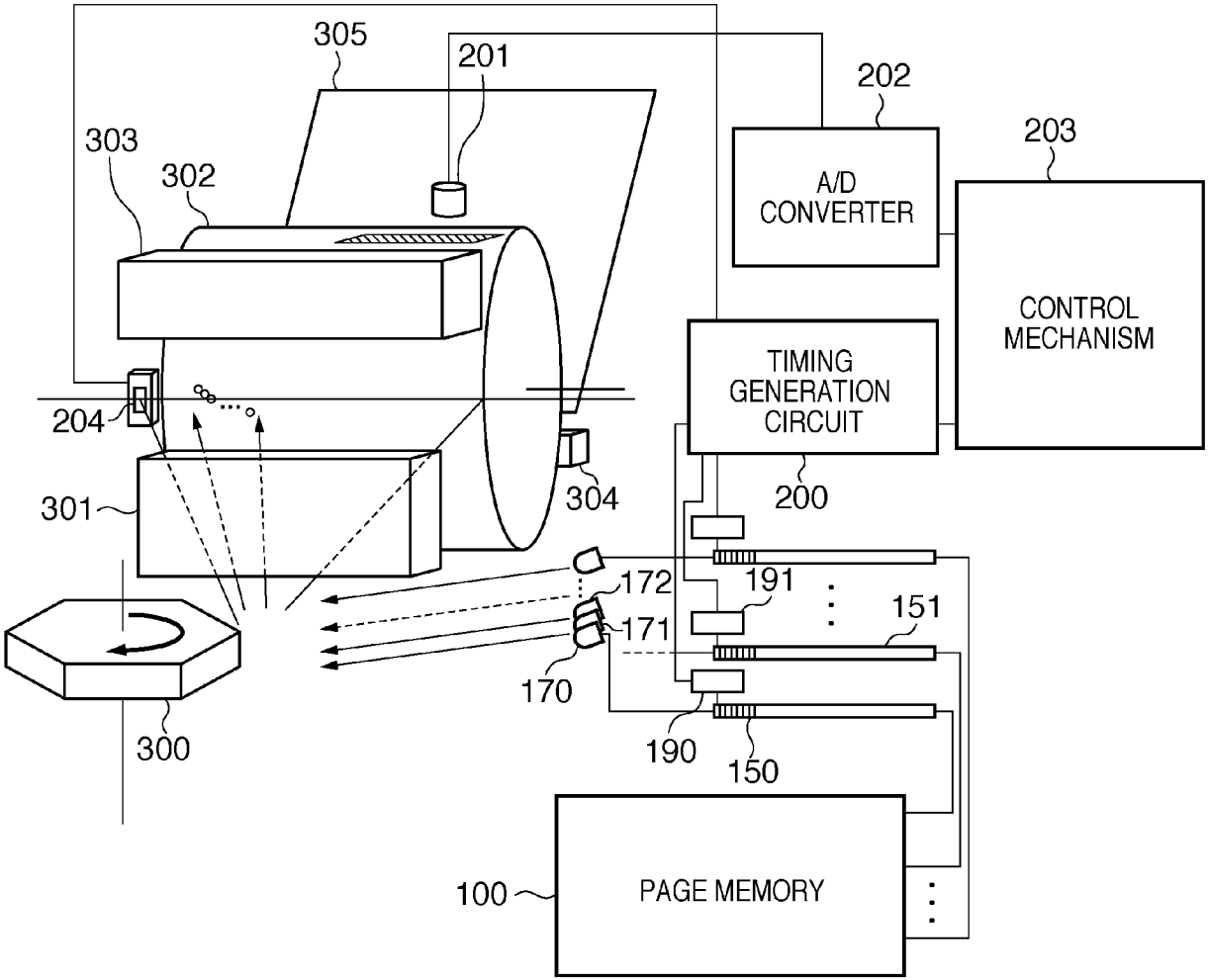
FIG. 8 is a schematic diagram that shows a hardware configuration according to a first embodiment.

FIG. 8 schematically shows the hardware configuration of the present embodiment. Here, the number of light sources is expressed as k. A page memory 100 stores a bitmap of a printing image formed by an image forming unit (not shown). The bit image in the page memory 100 is read out in k lines, and the k lines are transmitted to k line buffers 150 to 150+(k−1). The line buffer 150 performs output, synchronizing a digital data rendering timing to an operation of a printing mechanism. A latent image rendering start time is determined using a read-out start signal generated based on a synchronous sensor signal. Clock generation circuits 190 to 190+(k−1) are provided for each light source, pixel lines are read out at clock timings instructed by a timing generation circuit 200, and laser diodes 170 to 170+(k−1) are driven. Rendering time control for controlling a rendering start time is realized by the clock generation circuits 190 to 190+(k−1), and scanning time control for controlling a scanning start time for a scanning target is realized by the timing generation circuit 200. Note that the read-out start timing signal for the bit-image lines in the individual line buffers is based on the input of a synchronous sensor 204, with the addition of the amount of delay that conforms with the transmission timing of the individual line buffers. The bit-image lines of the line buffers are transmitted at an operation clock for each individual line buffer, and are inputted to the laser diodes 170 to 170+(k−1) as a driving signal. The timing generation circuit 200 holds timing information of each light source for an actual synchronization signal, and driving clock information of each light source. Then, from the actual synchronization signal obtained from the synchronous sensor 204, and the set timing information of each light source, the transmission timing of an image signal for driving each laser light source is determined, and laser driving is performed.

A density sensor 201 reads the density of a toner image on the photosensitive member. Note that it is desirable that the density sensor 201 can move in the main-scanning direction in order to detect a density gradient along the main-scanning direction, or has a certain length in the main-scanning direction that enables the detection of a density gradient. An A/D converter 202 converts sensor output into digital numerical values. A control mechanism 203 adjusts the oscillation frequency of the clock generation circuit 190 and a timing signal, from the output of the density sensor 201. A polygon mirror 300 causes the beams of light outputted by a laser diode group to be scanned on the photosensitive member 302. An optical system 301 converts the equiangular scanning performed by the polygon mirror 300 into the constant speed scanning on the photosensitive member 302. Light rendering is performed through rendering performed by the light source group on a photosensitive member 302, and a light rendering is developed as a toner image and transferred to a sheet. A developing device 303 supplies toner to a latent image on the photosensitive member 302, and makes the latent image a real image as a toner image. A transfer mechanism 304 transfers the toner image on the photosensitive member 302 to a sheet 305. The toner image transferred to the sheet 305 is fixed to the sheet with heat and pressure by a fixing mechanism (not shown), and becomes print output. Latent image rendering is performed through the above processing. Note that various operations described later are realized by the control mechanism 203 executing programs held in a printing apparatus or in the storage area (not shown) of an external storage device connected to the printing apparatus.

Processing Flow

Next, processing performed by the control mechanism 203 of the present embodiment is described with reference to FIG. 9. Note that density measurement for timing correction is performed by, as described above, forming the pattern shown in FIG. 7 in the position on the carrier, and measuring the pattern. This processing is executed following the end of normal printing. In S1001, before the next normal printing is performed, a pixel pattern for density measurement is formed. Note that since the pixel pattern here is a repetition of an uncomplicated pattern, the pixel pattern may be formed in the page memory 100, or an image in a storage element such as a ROM may be repeatedly transmitted to the line buffers directly. After that, in S1002, the formed pixel pattern is developed into a toner image. The color of the developed pixel pattern is measured with the density sensor 201, and the results are converted into measured values by the A/D converter 202. Here, the measured pixel pattern is not transferred to a sheet as it is in normal printing, but instead is removed by a remaining toner cleaner (not shown). In S1003, the density of one or more pixel patterns is measured. After that, in S1004, the amount of density fluctuation relative to the present set value, in other words, a gradient is estimated. Note that even if the same density difference is detected, a correction value to be adjusted is different depending on a set value at the present point in time that has already been set. Next, in S1005, correction information based on a set value of the pixel clock and a set value of the amount of synchronization signal delay at the present point in time of each light source is read out. Note that since a correction value fluctuates for each apparatus that realizes the present embodiment, the value defined in advance for each apparatus is held in the timing generation circuit 200, and referenced. A correction value is determined in advance in a trial-and-error manner, for example. A correction value is a value that shows a correction amount for a current frequency of a pixel clock, for example. Subsequently, in S1006, a correction value is calculated from the obtained estimated value of the amount of change, and the set value at the present point in time. Subsequently, in S1007, the calculated correction value is reflected in the pixel clock and the amount of synchronization signal delay of each light source, and a rendering start time and a scanning start time are set. After that, the processing returns to a normal printing sequence.

Through the above processing, using a pixel pattern, an existing density reading unit can detect pixel shift on a photosensitive member, and fluctuation of a pixel clock through density change. Further, by providing an image pattern sensitive to such fluctuation as a specific pattern, and performing rendering in synchronization with the light source lines, information on the amount of fluctuation can be detected, and correction can be performed. Furthermore, since many of the existing printing apparatuses have a configuration in which a density sensor is already mounted, the dual-use is possible, which can suppress the cost.

Second Embodiment

Although there are several factors of environmental fluctuation in printing apparatuses, one main factor of environmental fluctuation for an optical system is temperature. Particularly, many laser beam printers adopt an optical system using an aspheric surface lens, and if a resin lens is adopted, fluctuation due to temperature is great. In the present embodiment, the amount of fluctuation in an image is estimated by detecting the temperature of the optical system so as to perform correction.

Property fluctuation due to temperature fluctuation of the optical system is measured in advance, and saved as parameters for the pixel clock and a phase synchronization timing of each light source. For example, when the output result of a temperature sensor is directly used, or a time lag exists between the output of the temperature sensor and actual heat deformation of the optical system, a parameter is selected based on an output fluctuation curve, and control is performed.

Hardware Configuration

Figure 10:
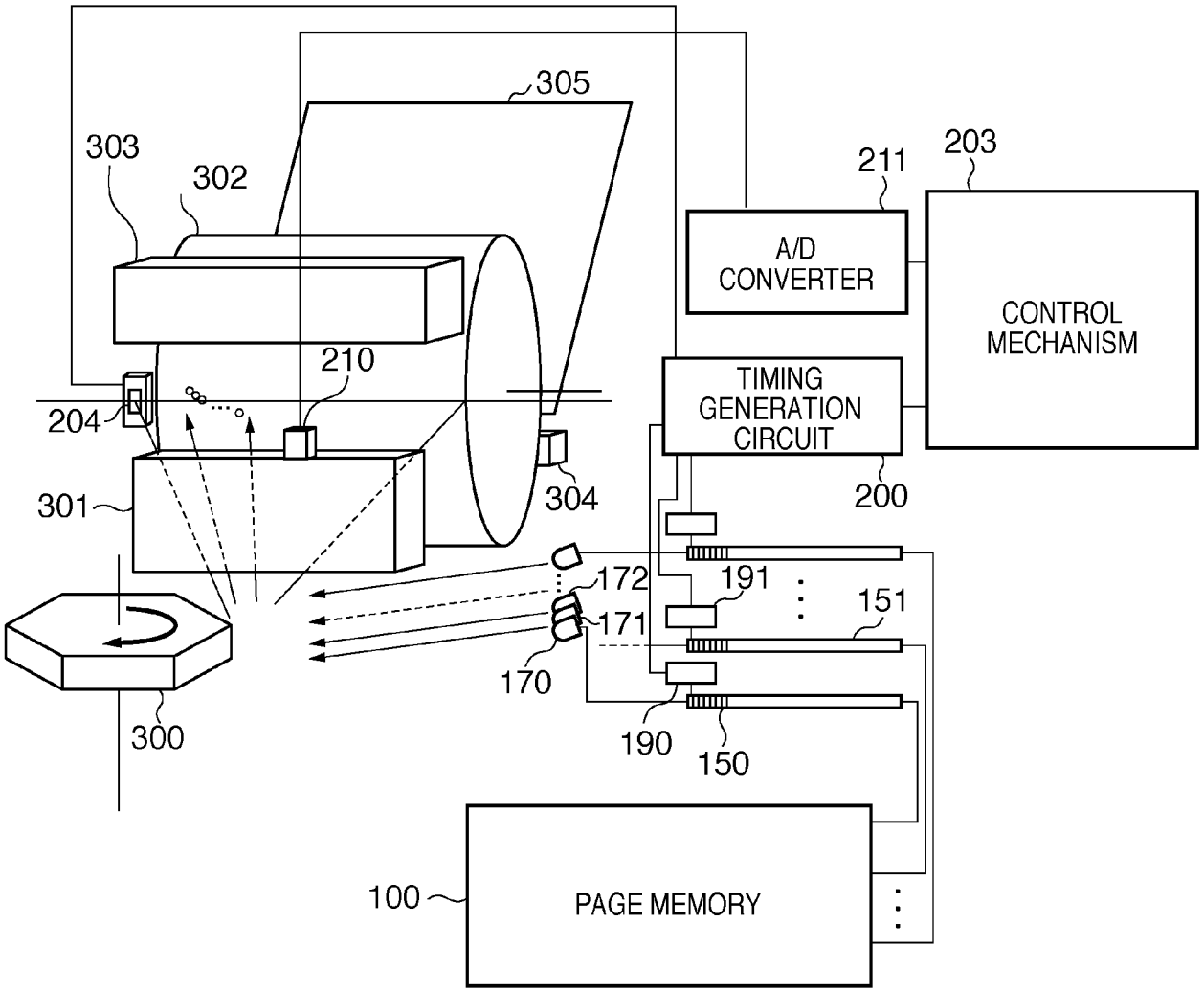
FIG. 10 is a schematic diagram that shows a hardware configuration according to a second embodiment.

FIG. 10 shows the schematic hardware configuration of the present embodiment. Since most of the configuration is similar to that of the first embodiment, only the difference is described here. In this configuration, a temperature sensor 210 is provided. The temperature sensor 210 detects the environmental temperature of the optical system at pixel positions of the temperature sensor. An A/D converter 211 converts the output of the temperature sensor 210 into digital numerical values. The pixel clock and the amount of synchronization signal delay of each light source corresponding to the temperature of the optical system are set during a time between sheets or between jobs. In the present embodiment, relative correction for the set value at the present point in time is not performed, but rather a correction value corresponding to the value of the temperature sensor is simply used. Here, a look-up table is provided as a correction value holding unit that holds correction values, and a correction value is obtained from the table and set.

Processing Flow

Figure 11:
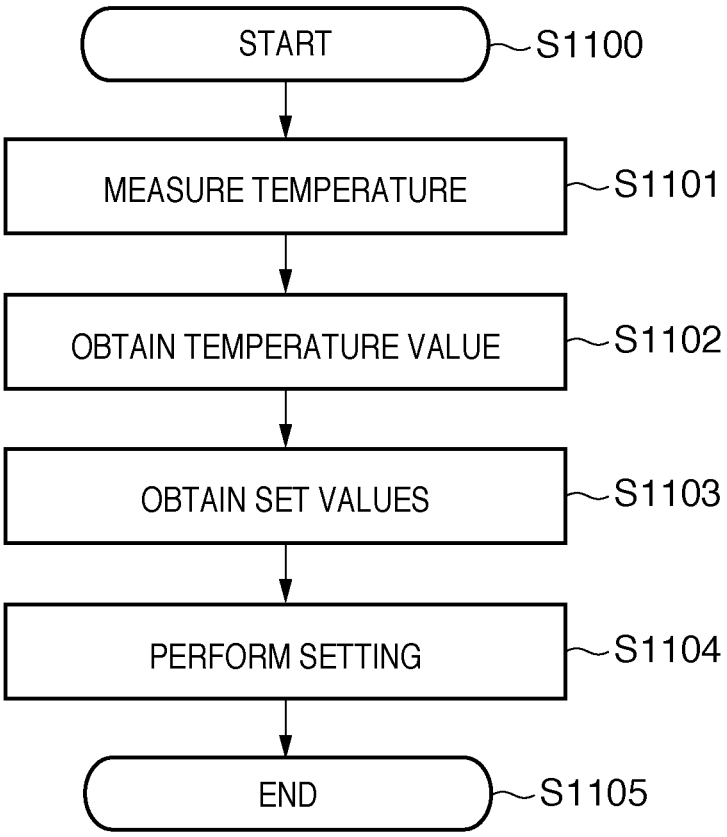
FIG. 11 is a flowchart that shows processing according to the second embodiment.

Next, the flow of processing of the present embodiment is described with reference to FIG. 11. Although the execution timing of this processing is not particularly limited, it is assumed that this processing is executed following the end of normal printing, for example. First, after processing starts, in S1101, the temperature sensor 210 executes environmental temperature measurement. Subsequently, in S1102, the A/D converter 211 obtains the measured temperature value. Subsequently, in S1103, based on the obtained temperature value, the pixel clock and the amount of synchronization signal delay of each light source are obtained from the look-up table defined in advance. Subsequently, in S1104, based on the values obtained in S1103, a rendering start time and a scanning start time are set for the timing generation circuit 200 and the clock generation circuits 190 to 190+(k−1).

In the above, a control method for correcting quality deterioration, such as pixel shift that has occurred due to temperature change, is presented. Accordingly, in consideration of the amount of fluctuation that has occurred due to temperature change, a rendering start time and a scanning start time can be corrected.

Third Embodiment

A print output environment also exists in which an environment sensor and a density sensor that obtain information indicating causes of fluctuation in a rendering width of a pixel are not provided. In the present embodiment, in the above environment, an environmental temperature is estimated from an energization history and operation frequency, the environmental temperature is estimated according to the estimated temperature, and the pixel clock and synchronous timing of each light source are controlled. Information effective in estimation of temperature is collected, such as calendar information, time information, the latest energization information, and the last use history information, and from such information, the temperature of the optical system immediately after energization is estimated. In addition, a temperature rise rate due to an energization time period and operation of each unit is estimated, the estimated temperature of the optical system at the present point in time is calculated, and control based on the estimated temperature is performed.

Figure 12:
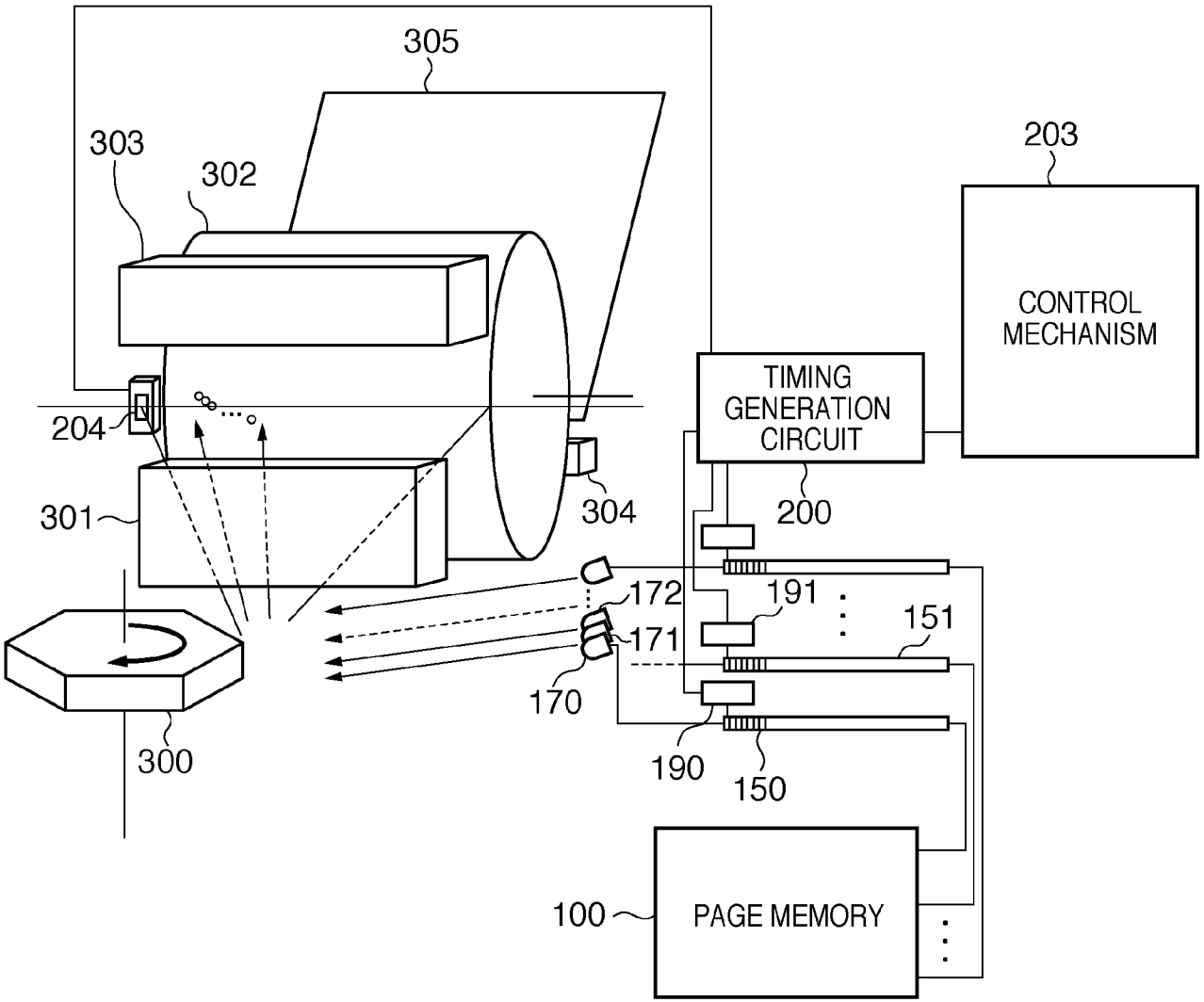
FIG. 12 is a schematic diagram that shows a hardware configuration according to a third embodiment.

FIG. 12 is a schematic diagram that shows the hardware configuration of the present embodiment. Here, a printing mechanism is not provided with a mechanism for measuring an environmental state.

Figure 13A:
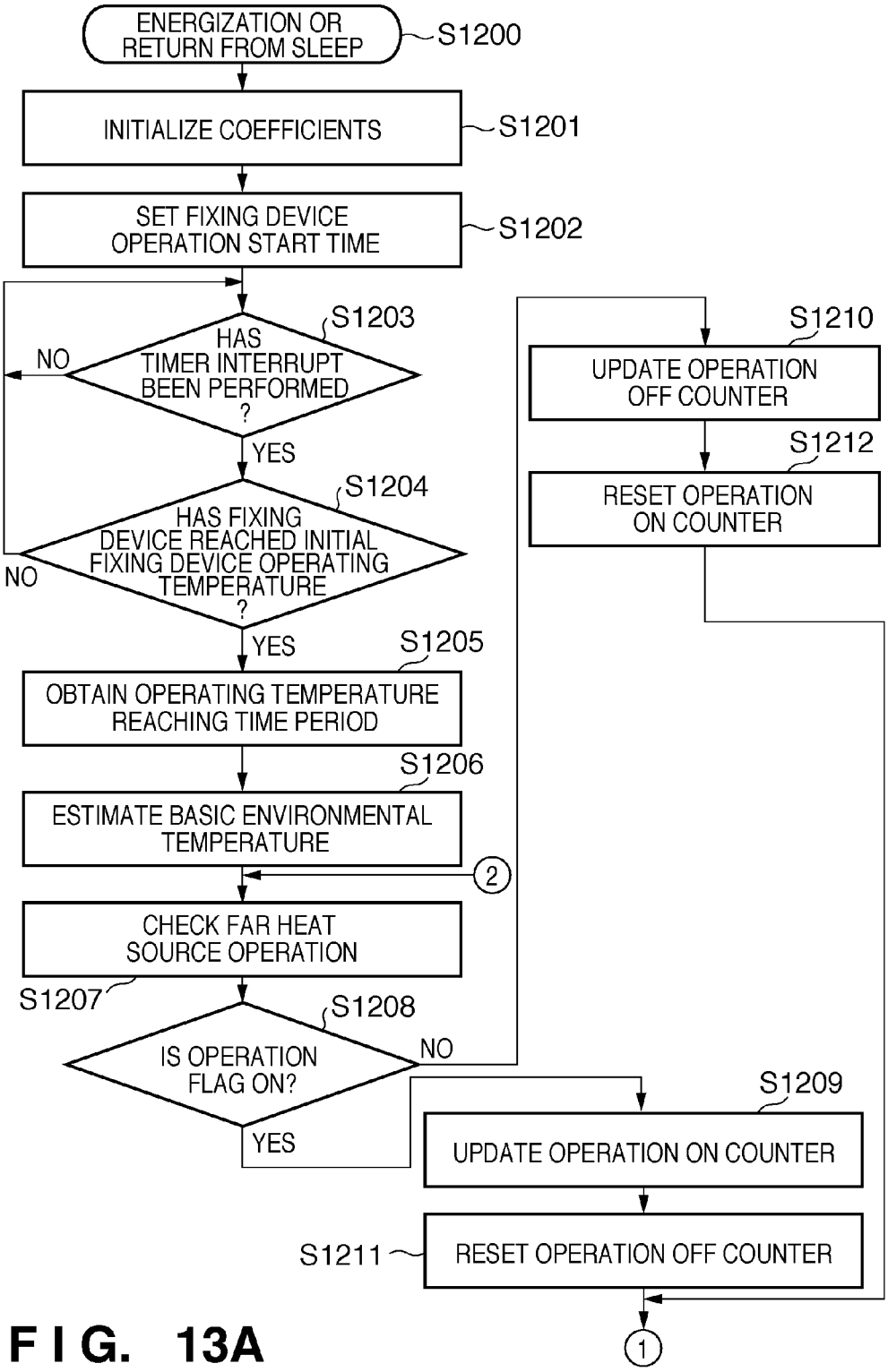
FIGS. 13A and 13B are flowcharts that show processing according to the third embodiment.
Figure 13B:
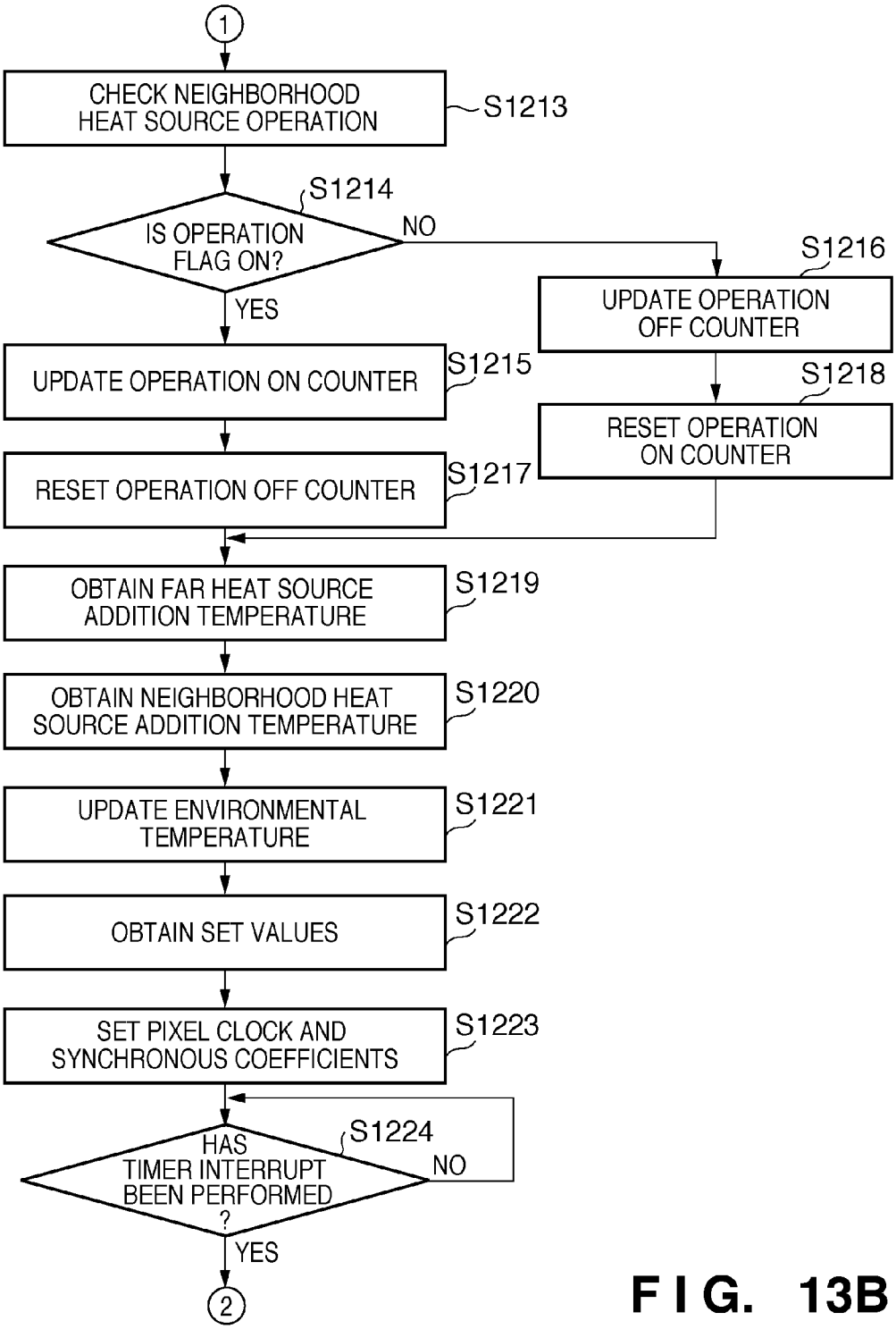

Next, the algorithm of the present embodiment is shown in FIGS. 13A and 13B. Coefficients that are controlled based on the configuration of a normal image forming unit in a laser printer or a copying machine, and according to which environmental status can be estimated include the following examples. Such examples include a total number of sheets printed, the number of sheets printed and a printing time of each print job, and a timer. A main temperature determination factor is heat generated by the optical unit itself. The optical unit is sealed in order not to let dispersion of a laser beam leak outside. Although the amount of heat generated by the polygon motor itself is small compared with the amount of heat generated by other systems of the printing apparatus, the polygon motor is a heating element near the optical system, and is in the sealed space, and accordingly the polygon motor is important as a main temperature estimation factor. In view of this, it is effective to estimate a driving time period of the polygon motor from the number of sheets printed and the timing of a print job. Further, the primary outside environment factor of the optical system is heat generated by the printing mechanism itself. For example, a fixing mechanism is an extremely great heat source, and also a transport mechanism consumes greater electric power and generates a greater amount of heat compared with the polygon motor. Further, the light source of an image reading unit also acts as a heat source. Even a slight amount of heat of the printing mechanism itself has great influence if it is transmitted to the optical unit. These factors are estimated based on an energization time period, the control timing of a fixing device, and an operating time.

Processing Flow

FIGS. 13A and 13B show a control procedure of the present embodiment assuming two heat sources being provided in far and neighborhood positions. Note that in the present embodiment, the operation start time and operation end time of the heat sources can be detected. For example, in the case of the fixing device, in ON/OFF processing, an operation state flag is provided, and set to ON and OFF according to the actual operation. A counter corresponding to the flag is further provided. If the flag is checked during the timer interrupt processing performed at fixed time intervals, and processing for updating the counter is performed when the flag is ON, an operating time period can be detected. Further, the number of heat sources is not limited to two, and for example, may be defined for every mechanism that can serve as a heat source that a printing apparatus has.

After processing is started in S1200 (after energization or return from sleep), processing for initializing coefficients is performed in S1201. In the initialization processing, flags that show whether or not each heat source is in an operation state are updated, and a counter for measuring continuous operation time is initialized. Further, until estimation of the initial environmental temperature is completed, an environmental temperature is set to a temporary value. Note that what is difficult to estimate here is the length of a sleep state and the length of the power-supply-cutoff time before energization. If such stopped time period is long, it is possible to estimate that the temperature in the printing mechanism has returned to a normal temperature, and therefore the temperature rise due to the influence from each heat source may be based on the normal temperature. However, if the stopped time period is short, a significant amount of remaining heat may still remain in the printing mechanism. Therefore, the temperature is indirectly estimated from the length of a fixing device heat time. Accordingly, the operation start time of the fixing device is set in S1202.

After that, in S1203, a state of waiting for the timer interrupt performed at fixed time intervals is entered. When the timer interrupt is performed, the processing proceeds to S1204. In S1204, it is judged whether or not the fixing device has reached an operating temperature. If the fixing device has reached an initial fixing device operating temperature, the processing proceeds to S1205, and if it has not reached such temperature, the processing returns to S1203. Note that here, the temperature is normally detected with a temperature sensor provided in the printing apparatus. Therefore, the temperature sensor is different from the temperature sensor 210 used in the second embodiment. Further, the initial fixing device operating temperature, a temporary environmental temperature, and a reference time for reaching the initial fixing device operating temperature are defined in advance.

In S1205, a time for the fixing device to reach the operating temperature after return from sleep is obtained, and the processing proceeds to S1206. The operating temperature reaching time here indicates the difference between the start time set in S1202 and the time for reaching the initial fixing device operating temperature. In S1206, based on the obtained operating temperature reaching time, it is estimated whether the initial environmental temperature is high or low in the printing mechanism from the length of the time. As an estimation method, based on the obtained operating temperature reaching time, a correction value is obtained from the LUT defined in advance, and the obtained value is applied to the temporary environmental temperature. Accordingly, correction based on the time difference is performed on the temporary environmental temperature, so as to estimate an accurate environmental temperature. Note that here, if the operating temperature reaching time is shorter than the reference time, the correction value is a positive value, and it is estimated that the environmental temperature is higher than the temporary environmental temperature. In contrast, if it is longer than the reference time, the correction value is a negative value, and it is estimated that the environmental temperature is lower than the temporary environmental temperature. In other words, the environmental temperature is estimated based on the calculation formula using the LUT. Note that the LUT used here is defined in advance according to a device to be realized. Then, the current environmental temperature is updated to the value of the environmental temperature estimated here, and the processing proceeds to S1207.

In S1207, an operation flag related to operation of a far heat source is obtained. Next, in S1208, the value of the flag related to the obtained far heat source operation is judged. If the operation flag is ON, the processing proceeds to S1209, and if it is OFF, the processing proceeds to S1210. In S1209, an operation ON counter is updated. After that, in S1211, an operation OFF counter is reset. After that, the processing proceeds to S1213. In S1210, the operation OFF counter is updated. After that, in S1212, the operation ON counter is reset. After that, the processing proceeds to S1213.

Similarly, also regarding a neighborhood heat source, in S1213 to S1218, processing is performed on an operation flag and operation counters. In S1213, the operation flag related to operation of the neighborhood heat source is obtained. Next, in S1214, the value of the obtained flag related to operation of the neighborhood heat source is judged. If the operation flag is ON, the processing proceeds to S1215, and if it is OFF, the processing proceeds to S1216. In S1215, an operation ON counter is updated. After that, in S1217, an operation OFF counter is reset. After that, the processing proceeds to S1219. In S1216, the operation OFF counter is updated. After that, in S1218, the operation ON counter is reset. After that, the processing proceeds to S1219. Since the rise or fall of the temperature due to the heat sources does not have a simple coefficient of variation with respect to the duration time, in S1219, an addition temperature (far) is determined based on the counter of the far heat source with reference to the look-up table. Subsequently, in S1220, similarly to the far heat source, the look-up table is referenced using the duration time, the operation state flags, and the environmental temperature of the neighborhood heat source as arguments, and an addition temperature (neighborhood) is obtained. Note that the look-up table is registered such that the heating temperature is a positive number when the operation flag is set, and the heating temperature is a negative value when the operation flag is not set, which is considered to be a heat dissipation state.

Subsequently, in S1221, the addition temperatures of the respective heat sources are added to the environmental temperature so as to update the environmental temperature. In other words, the environmental temperature is obtained based on the following calculation formula.

Environmental temperature=basic environmental temperature+addition temperature(far)+addition temperature(neighborhood)

After that, the processing proceeds to S1222. In S1222, a set value of the pixel clock and a set value of the amount of synchronization signal delay of a light source that correspond to the updated environmental temperature are obtained from the clock generation circuit and the timing generation circuit, respectively. Subsequently, in S1223, based on the obtained values, the set value of the pixel clock and the set value of the amount of synchronization signal delay of each light source for the timing generation circuit 200 and the clock generation circuits 190 to 190+(k−1) are set. After that, the processing proceeds to S1224, and the state of waiting for the timer interrupt performed at fixed time intervals is entered. When the timer interrupt is performed, the processing proceeds to S1207. The subsequent processing is continued while the printing mechanism is operating.

Through the above processing, the influence on the print output accompanying a temperature change is estimated and corrected also in the print output environment in which the environment sensor and the density sensor are not provided, which makes it possible to maintain output quality.

Fourth Embodiment

A printing apparatus including a copier function includes a high quality input mechanism for printed materials in the configuration thereof. In the present embodiment, a pixel clock and a synchronous position are corrected utilizing such an image input mechanism. If a scanner function for image reading provided in a copying machine and the like is used as an input mechanism, it is possible to read an image not only as simple density information, but also as a density distribution pattern. By printing an interference pattern and the like that change due to fluctuation in the pixel clock so as to check the change in the interference, fluctuation of the pixel width can be detected. As a pixel pattern output unit, the printing apparatus prints and outputs a density detection pattern or an interference pattern, causes an image reading scanner to read the output image, and detects the amount of displacement. If the pixel pattern used is a density detection pattern, the pixel pattern to be printed is basically similar to that of the first embodiment. However, with the image reading scanner that can read the whole printing range of a sheet, it is possible to use a plurality of pixel patterns. Since the number of arrangements of the patterns and freedom thereof are increased, it is possible to arrange many pixel patterns, and increase correction accuracy.

Figure 14:
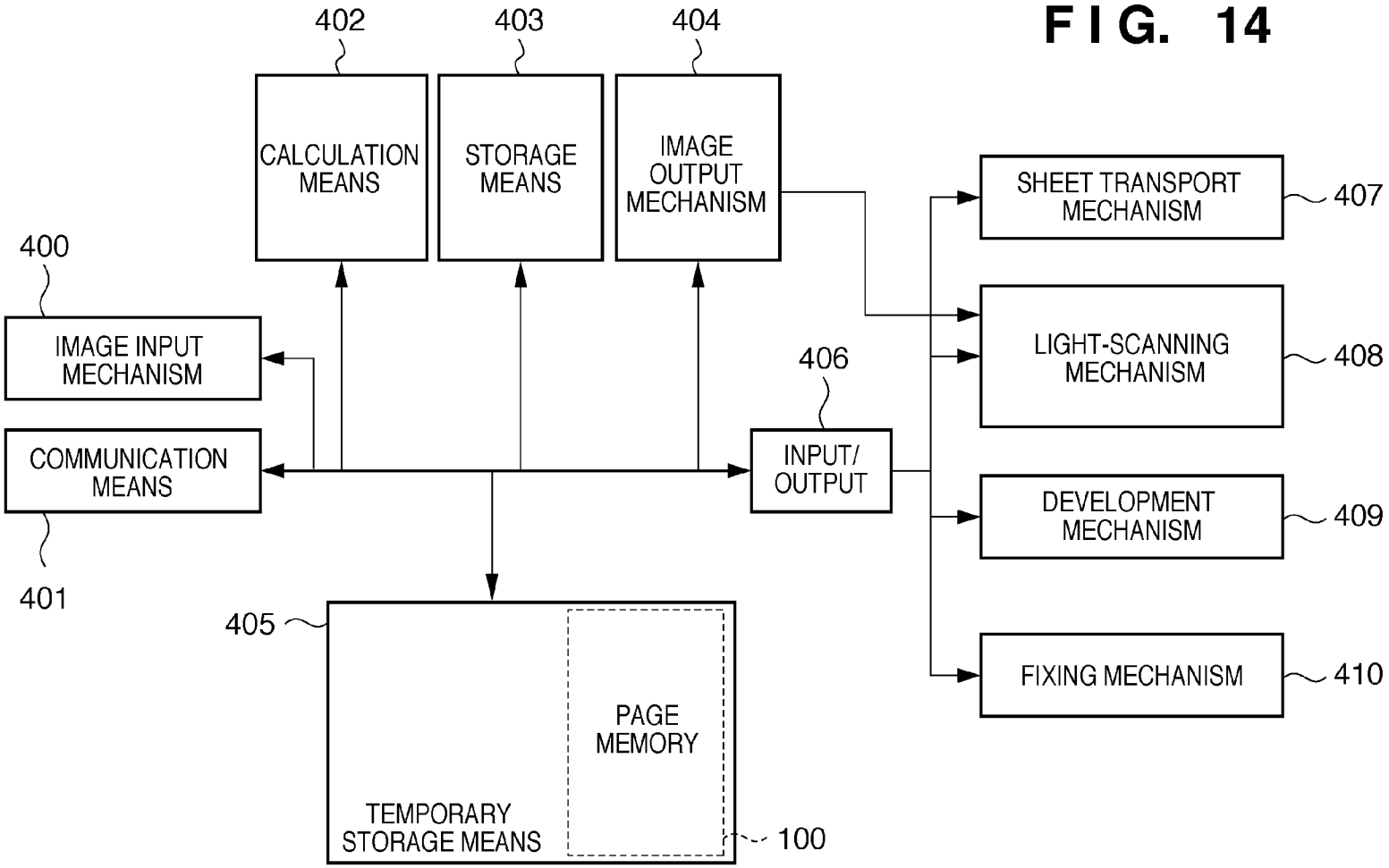
FIG. 14 is a drawing that shows an example of a system configuration of a copying machine, a multi-function peripheral, and the like according to an embodiment of the present invention.

A difference comparison is performed by arranging a reference density pattern on which fluctuation of an optical system does not have much influence, such as vertical lines or horizontal lines, and a pixel pattern as shown in FIG. 7, or a bilaterally symmetrical pattern. The configuration of the printing mechanism itself is similar to that of the third embodiment. FIG. 14 shows the hardware configuration of a multi-function peripheral of the present embodiment. An image output mechanism 404 includes the line buffers 150 to 150+(k−1), the clock generation circuits 190 to 190+(k−1), and the like. A light-scanning mechanism 408 includes the laser diodes 170 to 170+(k+1), the polygon mirror 300, the optical system 301, the transfer mechanism 304, and the like. A development mechanism 409 includes the developing device 303. Furthermore, as a hardware configuration, an image input mechanism 400, a communication means 401, a calculation means 402, a storage means 403, a temporary storage means 405, an input/output 406, a sheet transport mechanism 407, and a fixing mechanism 410 are provided.

Further, other than the pixel pattern as shown in FIG. 7, pixel pattern data for feature extraction may be provided, and fluctuation extraction may be performed through feature extraction. As a pixel pattern for feature extraction, it is easier to extract minute pixel fluctuation with a narrow line pattern without a pixel lump. Here, it is not necessary to cause the image cycle of the feature extraction pattern itself to match the number of light sources k, nor to match the phases thereof. In other words, with respect to the number of light sources k, the image cycle of the feature extraction pattern may be an integer multiple thereof, or may be a non-integer multiple thereof. Note that when an image whose cycle is a non-integer multiple is handled, if pixel shift occurs, it is assumed that the number of interference fringes that occur is an integer multiple, and therefore detection may be performed based on such interference fringes. Further, for feature extraction, FFT (Fast Fourier Transform) processing may be performed on the read image, and the frequency distribution in two directions may be extracted. Additionally, the feature may be extracted by obtaining the correlation function using the distance between pixels.

Figure 15:
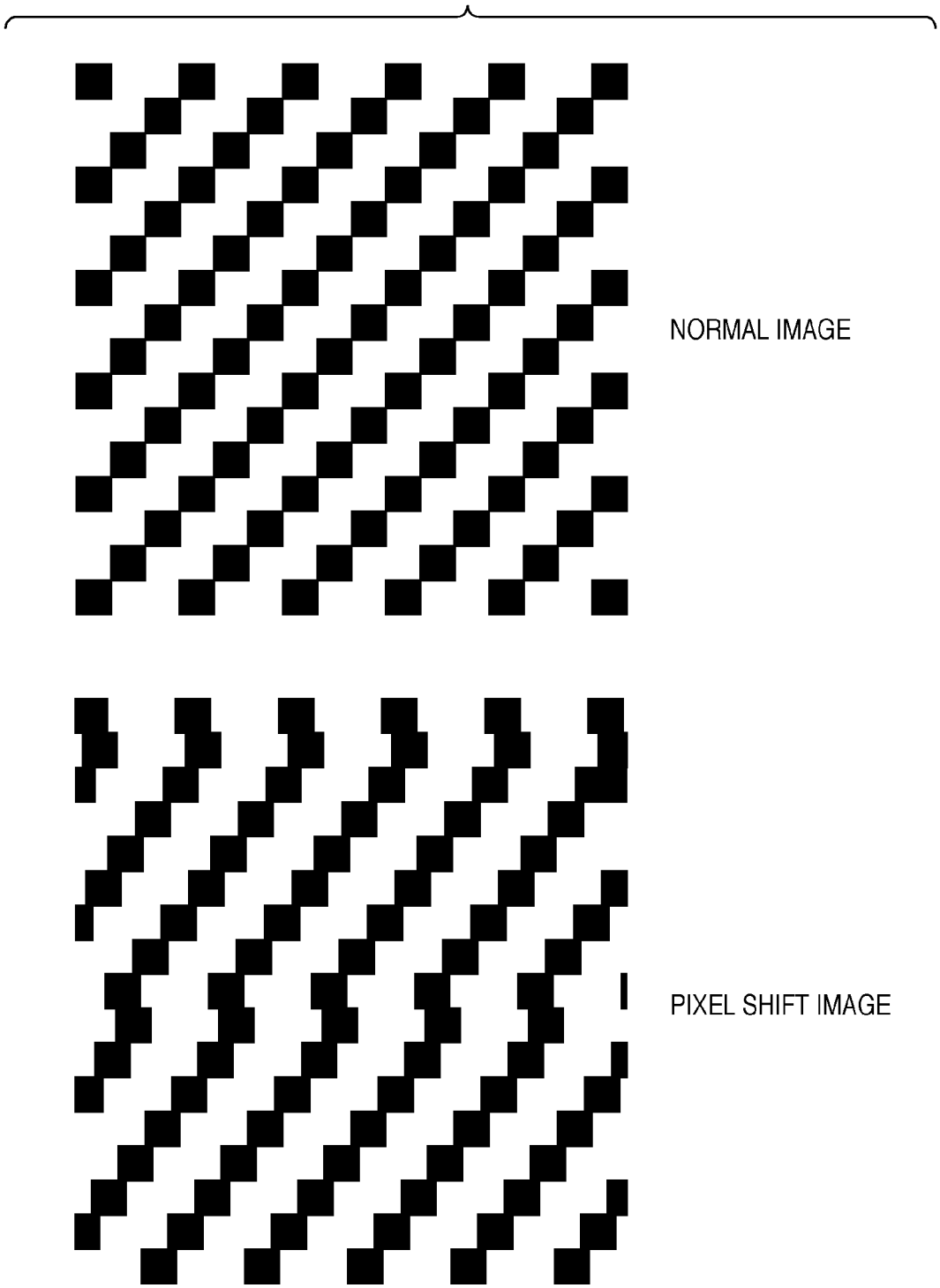
FIG. 15 is a drawing that shows an example of a pattern used for calibration according to an embodiment of the present invention.

For example, in the case of the image read with respect to the input of the dot pattern shown in "A. normal image" in FIG. 15 is "B. pixel shift image", the distance between the lines and the angle thereof have changed, and therefore shift occurs in the frequency peaks of line intervals, thus enabling detection. If the frequency peak shift is set as a reference value and a correction value table is provided, a pixel clock can be corrected.

Figure 16:
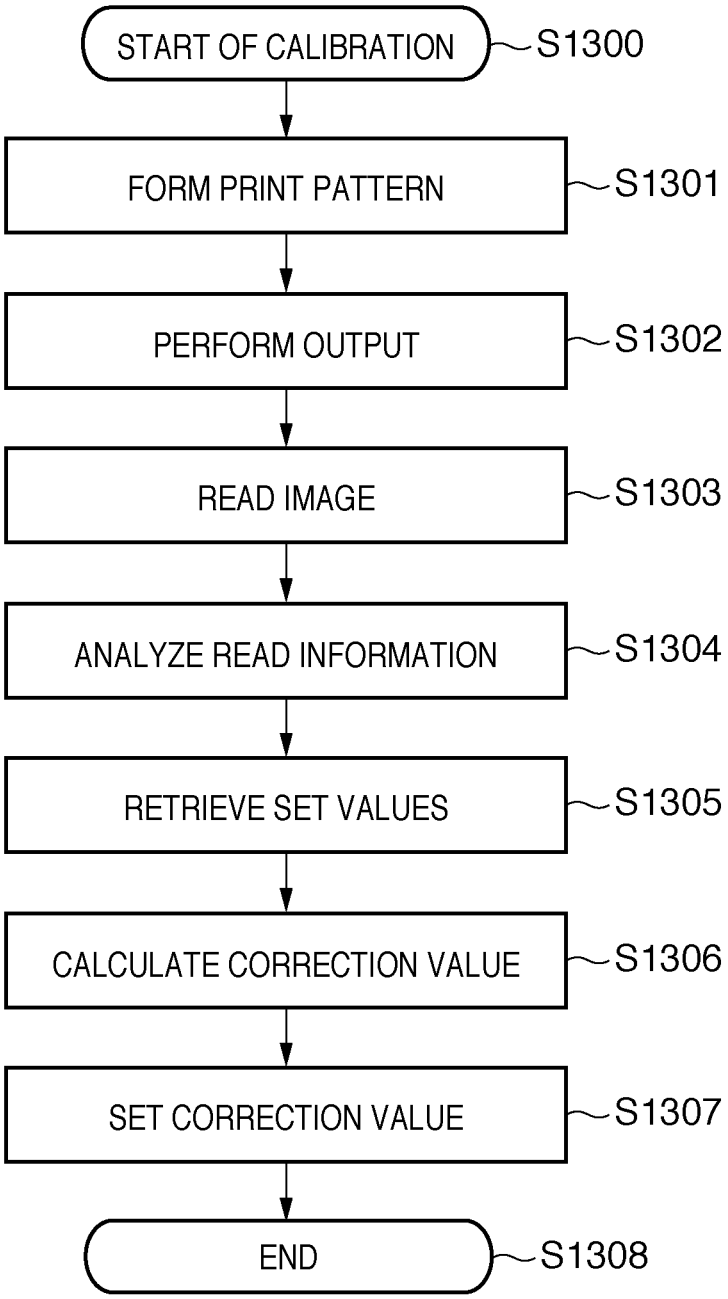
FIG. 16 is a flowchart that shows processing according to the third embodiment.

Next, a flowchart of the present embodiment is shown in FIG. 16. In S1300, this processing is started in order to perform calibration, and in S1301, a pixel pattern is formed. After that, in S1302, the formed pixel pattern is outputted on a sheet. After that, in S1303, the image of the outputted print pattern is read by the image input mechanism 400. After that, in S1304, the read information is analyzed. Here, a density difference is calculated using information read as image density information. That is, feature extraction processing is performed on the pixel pattern for feature extraction, and a parameter when the image is not distorted and a parameter at the present point in time are compared, so as to calculate the amount of fluctuation. The amount of shift is estimated based on this value. Note that even if the same density difference is detected, depending on the set value at the present point in time that has already been set, the correction value for shift that is to be adjusted is different. Next, in S1305, a set value of the pixel clock and a set value of the amount of synchronization signal delay of each light source at the present point in time are read out. After that, in S1306, correction value calculation is performed from the estimated value of the amount of shift and the set values at the present point in time. Environmental temperature correction is executed based on this correction value. Next, in S1307, the correction value is set with respect to the pixel clock and the amount of synchronization signal delay of each light source. Then, in S1308, calibration operation is ended.

Through performing the above processing, the amount of fluctuation is estimated using a plurality of patterns, thereby enabling the correction of the image that has been influenced by environmental fluctuation, and a high quality output image can be realized.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-069010, filed Mar. 19, 2009, which is hereby incorporated by reference herein in its entirety.

What is claimed is:

1. An electrophotographic image forming apparatus that performs latent image rendering using a plurality of light sources, the electrophotographic image forming apparatus comprising:

a scanner function for reading printed material;

a rendering time control unit that controls a latent image rendering start time at which each of the plurality of light sources starts rendering pixels on a photosensitive body;

a scanning time control unit that controls a scanning start time for each of the plurality of light sources;

a pixel pattern output unit that forms a plurality of pixel patterns corresponding to pixel pattern data defined in advance, and outputs the plurality of pixel patterns, wherein each of the plurality of pixel patterns has a number of cycles that is an integer multiple of a number of the plurality of light sources;

a correction value calculation unit that reads the plurality of pixel patterns outputted by the pixel pattern output unit using the scanner function, and calculates a correction value; and a synchronization unit that performs image output synchronization in which rendering is performed such that a specific line of the plurality of pixel patterns and a specific light source among the plurality of light sources are always in correspondence, wherein the rendering time control unit and the scanning time control unit respectively control the rendering start time and the scanning start time for each of the plurality of light sources based on the correction value calculated by the correction value calculation unit.

2. An electrophotographic image forming apparatus that performs latent image rendering using a plurality of light sources, the electrophotographic image forming apparatus comprising:

a scanner function for reading printed material;

a rendering time control unit that controls a latent image rendering start time at which each of the plurality of light sources starts rendering pixels on a photosensitive body;

a scanning time control unit that controls a scanning start time for each of the plurality of light sources;

a pixel pattern output unit that forms a plurality of pixel patterns corresponding to pixel pattern data defined in advance, and outputs the plurality of pixel patterns, wherein each of the plurality of pixel patterns has a number of cycles that is a non-integer multiple of a number of the light sources; and a correction value calculation unit that reads the plurality of pixel patterns outputted by the pixel pattern output unit using the scanner function, and calculates a correction value, wherein in a case in which pixel shift has occurred, the correction value calculation unit reads an interference fringe that has occurred using the scanner function, and wherein the rendering time control unit and the scanning time control unit respectively control the rendering start time and the scanning start time for each of the plurality of light sources based on the correction value calculated by the correction value calculation unit based on an amount of interference fringe shift.

3. An electrophotographic image forming method of rendering a latent image using a plurality of light sources, comprising:

a scanning step of reading printed material;

a rendering time control step of controlling a latent image rendering start time at which each of the plurality of light sources starts rendering pixels on a photosensitive body;

a scanning time control step of controlling a scanning start time for each of the plurality of light sources;

a pixel pattern output step of forming a plurality of pixel patterns corresponding to pixel pattern data defined in advance, and outputting the plurality of pixel patterns, wherein each of the plurality of pixel patterns has a number of cycles that is an integer multiple of a number of the plurality of light sources;

a correction value calculation step of reading the plurality of pixel patterns outputted in the pixel pattern output step and calculating a correction value; and a synchronization step of performing image output synchronization in which rendering is performed such that a specific line of the plurality of pixel patterns and a specific light source among the plurality of light sources are always in correspondence, wherein in the rendering time control step and the scanning time control step the rendering start time and the scanning start time are controlled, respectively, for each of the plurality of light sources based on the correction value calculated in the correction value calculation step.

4. An electrophotographic image forming method of rendering a latent image using a plurality of light sources, comprising:

a scanning step of reading printed material;

a rendering time control step of controlling a latent image rendering start time at which each of the plurality of light sources starts rendering pixels on a photosensitive body;

a scanning time control step of controlling a scanning start time for each of the plurality of light sources;

a pixel pattern output step of forming a plurality of pixel patterns corresponding to pixel pattern data defined in advance, and outputting the plurality of pixel patterns, wherein each of the plurality of pixel patterns has a number of cycles that is a non-integer multiple of a number of the plurality of light sources; and a correction value calculation step of reading the plurality of pixel patterns outputted in the pixel pattern output step and calculating a correction value, wherein in a case in which pixel shift has occurred, an interference fringe that has occurred in the scanning step is read, wherein in the rendering time control step and the scanning time control step the rendering start time and the scanning start time are controlled, respectively, for each of the plurality of lights sources based on the correction value that has been calculated based on an amount of interference fringe shift.

* * * * *